United States Patent [19]

Landa

[11] Patent Number: 4,678,177

[45] Date of Patent: Jul. 7, 1987

[54] REGISTERING METHOD

[75] Inventor: Benzion Landa, Edmonton, Canada

[73] Assignee: Savin Corporation, Stamford, Conn.

[21] Appl. No.: 256,132

[22] Filed: Apr. 21, 1981

Related U.S. Application Data

[63] Continuation of Ser. No. 39,270, May 16, 1979, abandoned, which is a continuation of Ser. No. 794,096, May 5, 1977, abandoned.

[51] Int. Cl.[4] ..... B65H 9/04

[52] U.S. Cl. ..... 271/238; 271/245; 271/250; 271/253

[58] Field of Search ..... 271/236, 237, 238, 226, 271/227, 234, 240, 245, 250, 253, 254, 255, 228–233, 235, 239, 241–244, 246–249, 251, 252, 185; 198/416

[56] References Cited

U.S. PATENT DOCUMENTS

| | | | |
|---|---|---|---|
| 330,777 | 11/1885 | Downing | 271/238 |
| 1,002,332 | 9/1911 | Stern et al. | 271/236 |
| 2,428,769 | 10/1947 | Bobst | 271/227 |
| 3,408,140 | 10/1968 | Hemphill | 271/238 X |
| 3,955,494 | 5/1976 | Suzuki | 271/254 X |

*Primary Examiner*—Joseph J. Rolla

*Attorney, Agent, or Firm*—Shenier & O'Connor

[57] ABSTRACT

A method of and apparatus for accurately positioning a generally rectangular sheet being fed in a direction generally parallel to one edge thereof in which a first stop offset from the centerline of the sheet in the direction of feeding engages the leading edge of the sheet to initiate a turning action thereof and in which second and third edge stops engage the lateral edges of the sheet with reference to the direction of feed and at points adjacent to the sheet corners before appreciable turning movement of the sheet has taken place.

2 Claims, 2 Drawing Figures

FIG. 1
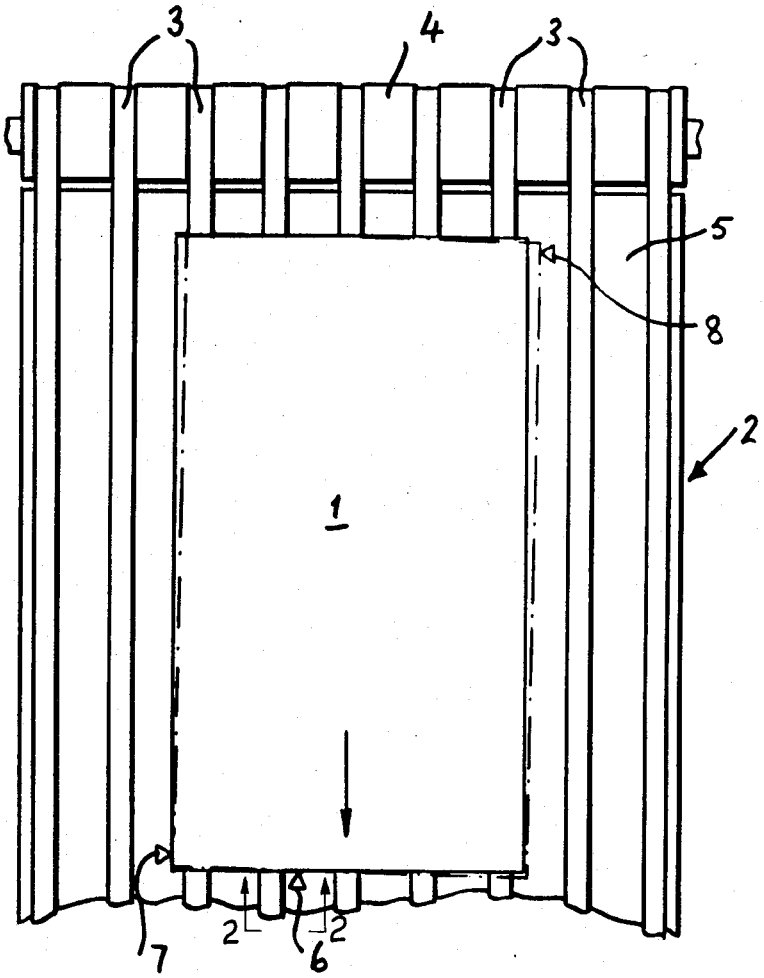
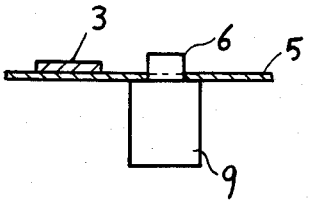
FIG. 2

REGISTERING METHOD

This application is a continuation of application Ser. No. 39,270, filed May 16, 1979, now abandoned, which is a continuation of application Ser. No. 794,096, filed May 5, 1977, now abandoned.

BACKGROUND OF THE INVENTION

This invention relates to an improved method of arresting the advance of an article for processing in a pre-determined position and to improved processing apparatus which makes use of such a method.

In a number of processes (e.g. multi-stage printing or copy production) it is necessary to perform a sequence of operation on the same article and it is necessary to ensure that the article is in exactly the same position for each operation. Many methods are known for arresting the advance of an article in a determined position, but the present method has advantages over the prior art methods particularly with regard to its simplicity and its accuracy of registering the article in the desired position.

BRIEF DESCRIPTION OF THE DRAWINGS

In the accompanying drawings, to which reference is made in the instant specification and which are to be read in conjunction therewith, and in which like reference numerals are used to indicate like parts in the various views:

FIG. 1 is a top plan illustrating apparatus for performing my registering method.

FIG. 2 is a sectional view of the apparatus shown in FIG. 1, taken along the line 2—2 thereof and drawn on an enlarged scale.

DESCRIPTION OF THE PREFERRED EMBODIMENT

The invention has particular utility in the operation of a color printing or electrophotographic machine in which a sheet of paper (usually rectangular) is successively subjected to a plurality of printing or exposure operations in a single printing or exposure station, but it is to be understood that the method of the invention is not limited to such processes.

According to one aspect of the present invention a method of ensuring that an article moving in a determined direction is stopped for processing in a desired position, comprises impeding movement of said article in said direction in such ways that the article starts to turn from said determined direction and arresting the turning movement with stop means disposed on opposite sides of the article.

In the particular case where the article is a rectangular sheet travelling on conveyor means in a direction parallel to one edge of the sheet, the method preferably comprises impeding forward movement of the sheet relative to the conveyor means by engagement of the leading edge of the sheet with a front stop located off center of the central line of the sheet parallel to said one edge, two edge stop means being disposed adjacent said one edge and its opposite edge but with at least one of the edge stop means spaced somewhat away from the adjacent edge when the sheet is travelling unimpeded in the determined direction but so close thereto that both edge stop means are contacted by the adjacent edge of the sheet before there is any substantial turning of the sheet on the conveyor means occasioned by engagement of the leading edge with the front stop. Suitably the edge stop means are located close to one leading corner of the sheet and close to the diagonally opposite trailing corner of the sheet.

Where the accurate registering of the position of the article is only temporarily required, and the article can then continue in the determined direction, the means employed for impeding movement of the article in the determined direction may be adjustably mounted relative to the article, so that the impeding effect can be removed when necessary. In the case of accurate registering of rectangular sheet travelling on a conveyor means, it is convenient to arrange for the front stop to be withdrawn from the leading edge of the sheet when it is desired to move the sheet forward again.

According to a further aspect of the invention a printing or copying machine having a process station in which a rectangular sheet of given size is operated upon, comprises conveying means on which the sheet is conveyed in a direction parallel to one edge through the process station, a front stop means located off center of the central line of the sheet parallel to said one edge, two edge stop means disposed adjacent said one edge and its opposite edge but with at least one of the edge stop means spaced somewhat away from the adjacent edge when the sheet is travelling unimpeded in the determined direction but so close thereto that both edge stop means are contacted by the adjacent edge of the sheet before there is any substantial turning of the sheet on the conveyor means occasioned by engagement of the leading edge with the front stop, the sheet being operated on when its edges are contacted by all three stop means.

The invention will now be further described, by way of example, with reference to the schematic drawing which shows part of an exposure station of an electrophotographic color copying machine.

The drawing shows a sheet 1 of electrophotographic copying paper (e.g. zinc oxide coated paper) travelling in the direction of the arrow on a conveyor generally designated 2. The conveyor 2 comprises a plurality of parallel spaced-apart endless belts 3 which are located in grooves in a driving roller 4. The sheet 1 is conveyed in the direction of the arrow by virtue of frictional engagement between the underside of the sheet 1 and the upper supporting surface of the belts 3. After leaving the roller 4, the belts pass over a base sheet 5.

The base sheet 5 defines a part of an exposure station of an electrophotographic copying machine at which a latent electrostatic image will be formed on the uniformly charged upper surface of the sheet 1, by exposing the latter to an optical image projected downwardly onto the sheet 1 from above. In a color reproduction process it is necessary to produce at least two superimposed images, the second or subsequent latent electrostatic image being formed after at least the first color image has been applied to the sheet. Precise registering of the sheet 1 in the exposure station is essential if well-defined color reproductions are to be obtained and the simple equipment shown in the drawing has been found to achieve such accurate registration of the sheet 1 in a determined position that a plurality of identical images can be formed on the same sheet one after the other without it being possible to detect any blurring of the resultant image formed on the sheet.

The registering of the position of the sheet is achieved with three simple edge-engaging stops indicated at 6, 7 and 8. The stop 6 is a front stop which is positioned to the left (as shown in the drawing) of the center line of the sheet 1 and engages the leading edge of the sheet. Because the front stop is positioned off center, and because the sheet is being conveyed by virtue of frictional engagement between the underside of the sheet and the belts 3, when the leading edge of the sheet contacts the front stop 6, a turning moment is generated, which causes forward movement of the sheet to be temporarily arrested while the sheet "slews" slightly on the belts 3. This slewing movement is arrested by the other two stops 7 and 8 which define edge stops and are located one adjacent the leading corner of the sheet 1 and the other adjacent the opposite trailing corner of the sheet 1. When the sheet is contacted by all three stops 6, 7 and 8, it is held stationary. Normally, the movement of the belts 3 would be stopped very shortly after the sheet 1 reaches its stable position in engagement with the three stops 6, 7 and 8, and would remain stationary during the exposure period of the reproduction process. This is desirable because movement of the belts 3 below the sheet 1 might induce some "fluttering" of the sheet even though the precise registration of the sheet is retained by the three stops.

When the required operation at the exposure station has been completed, the front stop 6 can be removed (e.g. downwardly below the level of the sheet 1 by any suitable means such as that illustrated at 9 in FIG. 2) so that the belts either immediately continue the advance of the sheet 1 in the direction of the arrow or else commence that further advance when their movement is resumed.

By locating the edge stops 7 and 8 close to diagonally opposite corners of the sheet the greatest accuracy of registration is obtained and this is generally the preferred positioning for the edge stops. However, it will be appreciated that these two edge stops can be moved closer to the transverse center of the sheet 1, and will still achieve highly accurate registration of sheet position. In practice, a very small "slewing" of the sheet 1 is all that is necessary. A slewing of between 1 and 2 degrees has been shown in the drawing but this is more than may be necessary. In a practical case, A4 size paper has been accurately positioned in an exposure station using a front stop 6 which is some 10 centimeters off center of the sheet and edge stops 7 and 8 which are spaced less than 1.0 mm from the edge of the sheet in its unslewed state.

Having thus described my invention what I claim is:

1. Apparatus for stationarily positioning a sheet of thin flexible paper-like material at a given location in a process station including in combination, means for gravitationally supporting and frictionally conveying a sheet of material along a path having a certain direction from a remote location to said given location with the leading edge of said sheet normally generally perpendicular to said direction, said conveying and supporting means permitting sliding movement of the sheet relative thereto in response to an obstacle encountered by an edge of said sheet, first stop means at said station for engaging the leading edge of a normally conveyed sheet at one side of the centerline thereof with reference to said direction while leaving the leading edge at the other side of said centerline free for initiating a turning movement of said sheet relative to said conveying means and to said path direction as it enters said given location, a second stop at said station positioned to engage one side edge of said sheet adjacent to a leading corner thereof and a third stop at said station positioned at a location along said path spaced rearwardly of the second stop to engage the other side edge of said sheet adjacent to a trailing corner thereof, said second and third stops positively arresting said turning movement after a predetermined movement while inhibiting sliding movement of said sheet relative to said first stop means generally in the direction of said turning movement accurately to hold said sheet at said station in a skewed position relative to said path direction to permit an operation to be performed on said sheet.

2. A method of stationarily positioning a sheet of thin flexible paper-like material at a given location including the steps of gravitationally supporting and frictionally conveying said sheet along a path having a certain direction from a remote location toward said given location with the leading edge of said sheet normally generally perpendicular to said direction while permitting sliding movement of the sheet in response to an obstacle encountered by an edge of said sheet, initiating a turning movement of said normally conveyed sheet relative to said path direction as said sheet enters said given location, and exerting a force on a side edge of said sheet positively to arrest said turning movement after a predetermined turning movement while inhibiting sliding movement of said sheet generally in the direction of said turning movement to stop said sheet at said location in a skewed position relative to said path direction, said sheet being generally rectangular and said conveying being in a direction generally parallel to an edge of said sheet, said turning step comprising engaging the leading edge of said sheet at a point spaced from the centerline of said sheet with reference to the direction of movement thereof, said arresting step comprising engaging the lateral edges of said sheet with reference to the direction of said movement thereof before appreciable turning has taken place, said arresting step comprising engaging one of said lateral edges adjacent to a leading corner of said sheet and engaging the other lateral edge adjacent to a trailing corner of said sheet.

* * * * *